US009767771B2

(12) United States Patent
Marttila

(10) Patent No.: US 9,767,771 B2
(45) Date of Patent: Sep. 19, 2017

(54) ATTACHMENT ARRANGEMENT FOR STRINGS OF STRINGED INSTRUMENT, ESPECIALLY GUITAR

(71) Applicant: TECNOMAR OY, Espoo (FI)

(72) Inventor: Tom Marttila, Espoo (FI)

(73) Assignee: TECNOMAR OY, Espoo (FI)

( * ) Notice: Subject to any disclaimer, the term of this patent is extended or adjusted under 35 U.S.C. 154(b) by 0 days.

(21) Appl. No.: 15/039,676

(22) PCT Filed: Dec. 18, 2013

(86) PCT No.: PCT/FI2013/051177

§ 371 (c)(1),
(2) Date: May 26, 2016

(87) PCT Pub. No.: WO2015/092115

PCT Pub. Date: Jun. 25, 2015

(65) Prior Publication Data

US 2016/0379608 A1 Dec. 29, 2016

(51) Int. Cl.
*G10D 3/12* (2006.01)
*G10H 1/32* (2006.01)
(Continued)

(52) U.S. Cl.
CPC ..... *G10D 3/12* (2013.01); *G10D 3/04* (2013.01); *G10D 3/14* (2013.01); *G10D 3/146* (2013.01);
(Continued)

(58) Field of Classification Search
CPC .. G10D 3/04; G10D 1/08; G10D 3/12; G10D 3/146; G10D 3/143
(Continued)

(56) References Cited

U.S. PATENT DOCUMENTS 4,171,661 A 10/1979 Rose
4,497,236 A 2/1985 Rose
(Continued)

FOREIGN PATENT DOCUMENTS

CA 2077736 A1 3/1994
DE 3526928 A1 4/1986
(Continued)

OTHER PUBLICATIONS

Supplementary European Search Report (SESR) dated Jun. 23, 2017 for EP Application No. 13899838.0.
espacenet English abstract of DE 3520843 A1.

*Primary Examiner* — Kimberly Lockett
(74) *Attorney, Agent, or Firm* — Ladas & Parry LLP

(57) ABSTRACT

The invention relates to an attachment arrangement for the strings of a stringed instrument, especially a guitar. To the body of the stringed instrument is attached a bridge body, first restraining means for restraining the strings from the first end area, second restraining means, which are arranged in conjunction with the bridge body for restraining the strings from the second end area. Lever means are arranged in conjunction with the bridge body in order to move the second restraining means for temporarily loosening and/or tightening the strings by means of a lever part included in the lever means. The lever means are provided with moving means comprising at least one moving mechanism, which is a mechanism separate from the lever means. One or more second restraining means are arranged to move with respect to the bridge body. The moving means are arranged to transmit the movement of the lever means into the desired movement of one or more restraining means.

18 Claims, 3 Drawing Sheets

Figure 1:
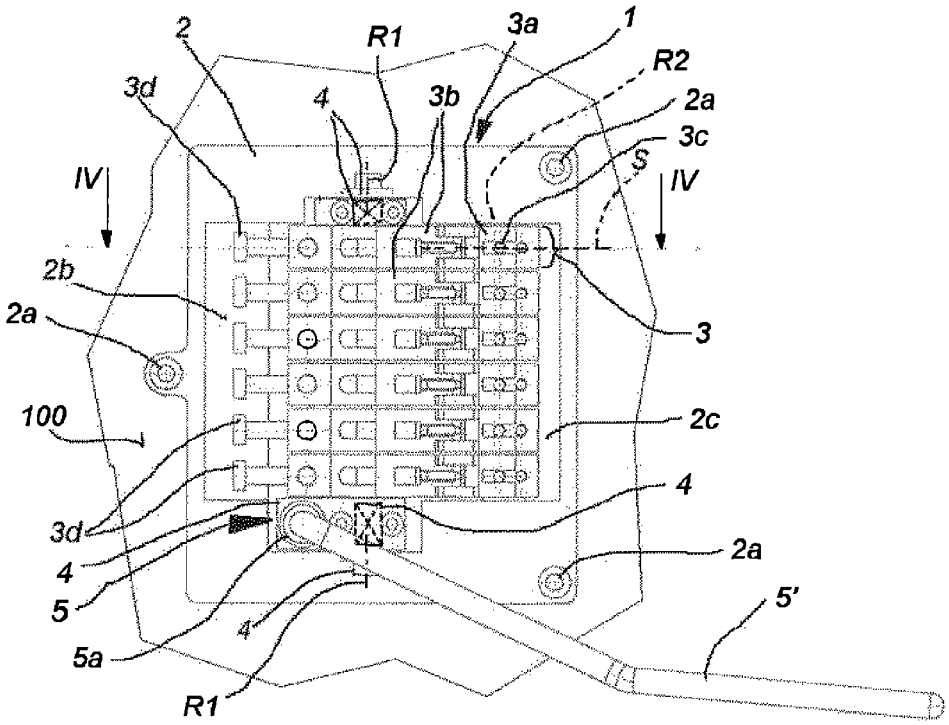

(51) Int. Cl.
*G10D 3/04* (2006.01)
*G10D 3/14* (2006.01)

(52) U.S. Cl.
CPC ..... *G10H 1/32* (2013.01); *G10D 3/143* (2013.01); *G10H 2210/201* (2013.01)

(58) Field of Classification Search
USPC ..... 84/267, 298
See application file for complete search history.

(56) References Cited

U.S. PATENT DOCUMENTS

| | | | | |
|---|---|---|---|---|
| 4,686,883 | A | 8/1987 | Piche et al. | |
| 5,986,190 | A | 11/1999 | Wolff et al. | |
| 6,100,459 | A | 8/2000 | Yost | |
| 2004/0159204 | A1* | 8/2004 | Rose ..... | G10D 3/04 84/298 |
| 2005/0204892 | A1 | 9/2005 | Minakuchi | |
| 2010/0064877 | A1 | 3/2010 | Deck | |

FOREIGN PATENT DOCUMENTS

| | | | |
|---|---|---|---|
| DE | 3520843 | A1 | 12/1986 |
| FR | 2 780 542 | | 12/1999 |

* cited by examiner

ATTACHMENT ARRANGEMENT FOR STRINGS OF STRINGED INSTRUMENT, ESPECIALLY GUITAR

The invention relates to an attachment arrangement for the strings of a stringed instrument, especially a guitar, comprising a bridge body fixed to the body of the stringed instrument, first restraining means for restraining the strings from the first end area, second restraining means, which are arranged in conjunction with the bridge body for restraining the strings from the second end area, lever means arranged in conjunction with the bridge body in order to move the second restraining means for temporarily loosening and/or tightening the strings by means of a lever part included in the lever means.

From patent publication U.S. Pat. No. 4,171,661 and from its improved version. U.S. Pat. No. 4,497,236 is previously known this type of an attachment arrangement which restrains both ends of a string. From these publications is known a so-called Floyd Rose bridge construction of a guitar, which is a bridge construction widely used as such or in modified forms in current guitars. The bridge construction comprises second restraining means which are arranged to move simultaneously through a joint base plate connected to a lever in order to temporarily loosen and/or tighten the strings. In the construction, the bridge is in balance when the tractive forces exerted on the bridge by the strings tightened to the desired tune and by the, usually several, counter-springs comprised in the lever means are in balance. The strings are temporarily loosened by pressing the lever downwards (towards the body of the stringed instrument). All springs then loosen over the same distance as the base plate turns and, therefore, as the restraining means move with the lever, and the counter-springs tighten. Similarly, when the lever is lifted upwards (away from the body), all springs tighten over the same distance and the counter-springs loosen.

As a result of this structure, which changes the length of the strings simultaneously by the same amount (stretch and compression), and the different properties, especially the stretching and compressing properties (when loosening and tightening the springs), of strings of various thicknesses with respect to one another, the frequencies of the strings change in a different or undesired manner compared to one another. A particular disadvantage of this type of construction is that, in practice, the change in the pitch of thinner and more stretching strings remains small. This is often an undesirable property when loosening and/or tightening the strings temporarily.

A significant disadvantage of such floating bridge construction is that when the player raises the pitch of the string by moving it with a finger transversely to the fingerboard, so-called bending, this tightening string deviates the bridge in a direction loosening the strings, whereby the pitch of all other strings falls. With many pieces of music and playing styles this is a big problem and, therefore, many players have separate fixed-bridge guitars, which do not have this disadvantage, but with them can then obviously not be played pieces and musical styles in which it is essential to be able to change the pitch of the strings in the manner made possible by a moving bridge.

In addition to this, a problem with the bridge constructions described above is that the tuning of even just one string to a flat or sharp tune, or the breaking of the string, causes the remainder of the strings in the instrument to go completely out of tune. This is due to the loss of balance of the strings and the counter-springs, whereby all restraining means move from their original positions with the bridge. In this case, the tension, and thus the tuning of the rest of the strings, changes completely compared to the original situation. Balancing a flat or sharp tuned (even just one string) guitar in such a way that the tune remains correct takes a rather long time and if a string is broken, it is practically impossible to achieve the tune.

A further disadvantage of this type of structure is that operation both upwards and downwards requires turning the lever with considerable force. When the lever is pressed downwards, the strings loosen and their force acting on the bridge decreases steeply, whereas at the same time the counter-springs tighten and their force acting on the bridge increases. At the end, the player, therefore, has to overcome the force of the tightening counter-springs. Similarly, when the lever is pulled upwards, the strings tighten and their force acting on the bridge increases steeply, while the counter-springs at the same time loosen. In this case, the player has to overcome the force of the strongly tightening strings. This makes using the bridge by means of the lever hard, which hinders precise use of the lever.

Yet another disadvantageous feature of such bridge construction relates to a wide cavity or the like made in the framework for the counter-spring. Conventionally, such a cavity is made in the body (on its underside), directly underneath the strings. At the same time, microphones are located in their own cavities on the upper surface of the body. Therefore, the cavities lighten the body precisely at the strings, even to the extent that the thickness of the body may in places be 25-50% of the total thickness of the body. This is known to have a disadvantageous effect, for example, on the sustain of the sound of the guitar, that is, the sound dies out quicker due to the lesser mass of the body at the strings.

For example, from patent publication U.S. Pat. No. 4,686,883 is previously known a solution for altering the string-specific tension of guitar strings. In it are on the transverse axis of the lever fitted formed pieces which move a rocker arm connected to each string. However, here the length of the free section of the strings remains unchanged and only the tension of the strings changes. Second restraining means cannot be used in conjunction with the bridge in the construction according to the publication U.S. Pat. No. 4,686,883, but the strings pass through v-notches at the ends of the rocker arms to an attachment point further on the rocker arm, whereupon on each string along this distance is formed a long non-sounding section, which is the reason why the instrument does not return into tune after the lever has been used. In this and many other bridge constructions, the strings pass through v-grooved wheels, in which case the pitch cannot be lowered, because a loose string would then easily slip out of the v-groove of the wheel and would not return to the v-groove once the strings re-tighten. The construction disclosed herein limits the rotational angles of the rocker arms to such small size that the pitch of at least the thinner and more stretching strings cannot be significantly altered. The construction only comprises a centering spring which returns the mechanism to its central position after the deviation, in which case, when the lever is pulled upwards, the player has to overcome the force generated by the strings with his hand, and the lever shaft is in addition far from the position of the player's hand which makes the lever long, thus further limiting the operating area, especially downwards. Both the use and the outward appearance are peculiar to players who are accustomed to a Floyd Rose bridge.

From the published patent application FR 2 780 542 is known one solution for altering the spring-specific tension of guitar strings. In it, each string is attached to a string-specific straight lever fitted on a transverse shaft located close to the upper surface of the body of the guitar. Each lever is a floating one and has its own lever-specific counter-spring. When the guitar is tuned, the string and counter-spring attached to each lever must, therefore, be balanced in such a way that the string is in tune and the lever exactly in its central position, which means that tuning and adjusting the whole instrument is a difficult and time-consuming procedure. The string-specific levers are deviated by formed pieces on both of their sides, the pieces being moved by a complex mechanism by the effect of the lever being turned. In its central position, the lever, therefore, floats between two formed pieces, and when the lever is deviated, the formed piece in question moves into contact with the side of the lever and begins to deviate it in the desired direction. An arrangement consisting of a lever floating by means of its own counter-spring and of two formed pieces is a complex one and in practice requires clearance around the central position in which the lever floats, and the clearance is in turn not good for the operation and the feel experienced by the player. A solution with two formed pieces and a lever between them does not make it possible in practice, for the formed piece to come into contact with a wheel or roller on the lever, but due to the lack of space, the operation must be based on sliding, which increases the friction of the mechanism and the wear enlarging the clearance and weakening the feel. When there are two formed pieces per string, changing the string-specific operating profiles is much more difficult and expensive. The return to the central position is based on a separate centering spring returning the lever mechanism to its central position, after which each lever tends to seek its own central position by the force of its counter-spring, within the clearance allowed by the formed pieces. However, outside the clearance, the lever mechanism connects the levers with one another and thus, for example, the breaking of a string affects the pitch of the remaining strings. The string is not attached from the end of the sounding part, but passes on the bridge over a separate piece or roll attached either to the end of lever or in front of the lever, and the adjustment of intonation is carried out by moving this piece or roll and not the attachment point of the string. This type of structure does not allow the string to be let completely loose, because a loose string easily moves away from its correct position on the piece or roll and does not return to its correct position when it tightens. The non-sounding part of the string between the attachment point and the piece or roll has the effect of the instrument not returning precisely into tune following the use of the lever. On the basis of the Figures, the solution does not include a lock saddle and without a lock saddle the strings are not restrained at their top end, which further impairs the stability of the tuning. The construction disclosed also limits the rotational angles of the rocker arms to such small size that the pitch of at least the thinner and more stretching strings cannot be significantly altered, and yet the geometry of the solution alters the height of the strings from the body of the instrument and the frets at the lower end of the neck markedly when the lever is used.

The publication U.S. Pat. No. 5,986,190 makes known a solution for altering the string-specific tension of guitar strings. In it, the strings are not restrained at either end of the sounding section, but the core of the operation is to use string-specific inserts at both ends of the sounding section, the inserts each having a hole for a string and being made of special material against which the friction of the string is low. However, since friction cannot be completely eliminated, the long unrestrained non-sounding sections of the strings result in the instrument not returning precisely into tune after the lever has been used. The length of the sounding section of the strings does not, therefore, change, and the alteration in string tension is based on attaching the strings either on the surface of cams mounted on a transverse shaft or to pistons moving in bores, which are moved by corresponding short rocker arms mounted on the surfaces of the cams mounted on the transverse shaft. The strings running on the surface of the cams increase the instability of tuning, because there is considerable friction between the string and the surface of the cam, and also the rocker arms corresponding to the pistons moving in the bores and the surfaces of the cams without a roller or wheel are a complex solution increasing instability due to frictions.

The aim of the present invention is to eliminate, or at least substantially reduce, the above-mentioned disadvantages.

To achieve the above aim, the present invention is characterised in that the lever means are provided with moving means comprising at least one moving mechanism, which is a mechanism separate from the lever means and in which one or more second restraining means are arranged to move with respect to the bridge body, and that the moving means are arranged to transmit the movement of the lever means into the desired movement of one or more restraining means.

By means of the string attachment arrangement according to the invention is achieved especially the aim of the invention according to which it is desirable to eliminate the changing of the frequency the of strings restrained from both ends in a different manner or undesirable manner when loosening and/or tightening the strings temporarily by means of a lever. By means of the invention is especially provided the possibility—in connection with the temporary loosening and/or tightening of the strings—of changing (while playing) the frequencies of individual strings in the desired manner with the moving means, for example, in such a way that the pitch of the strings changes in equal proportion when the lever is turned. This is not possible, for example, with the structure previously known from the patent publication U.S. Pat. No. 4,497,236.

Preferred embodiments of the invention are disclosed in the dependent claims.

The dependent claims also disclose embodiments by means of which the above-mentioned other disadvantages relating to problems caused by the strings breaking and to the use of force by the lever can be eliminated, or at least substantially reduced. Solving these problems substantially facilitates the formation of the desired sounds in the string attachment arrangement according to the independent claims.

Figure 2:
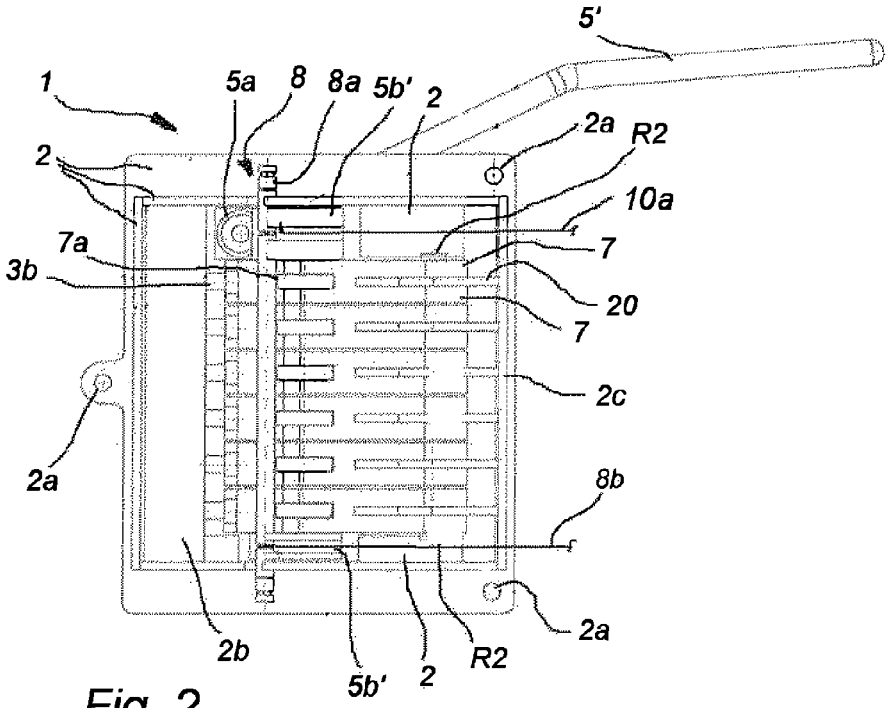
Figure 3:
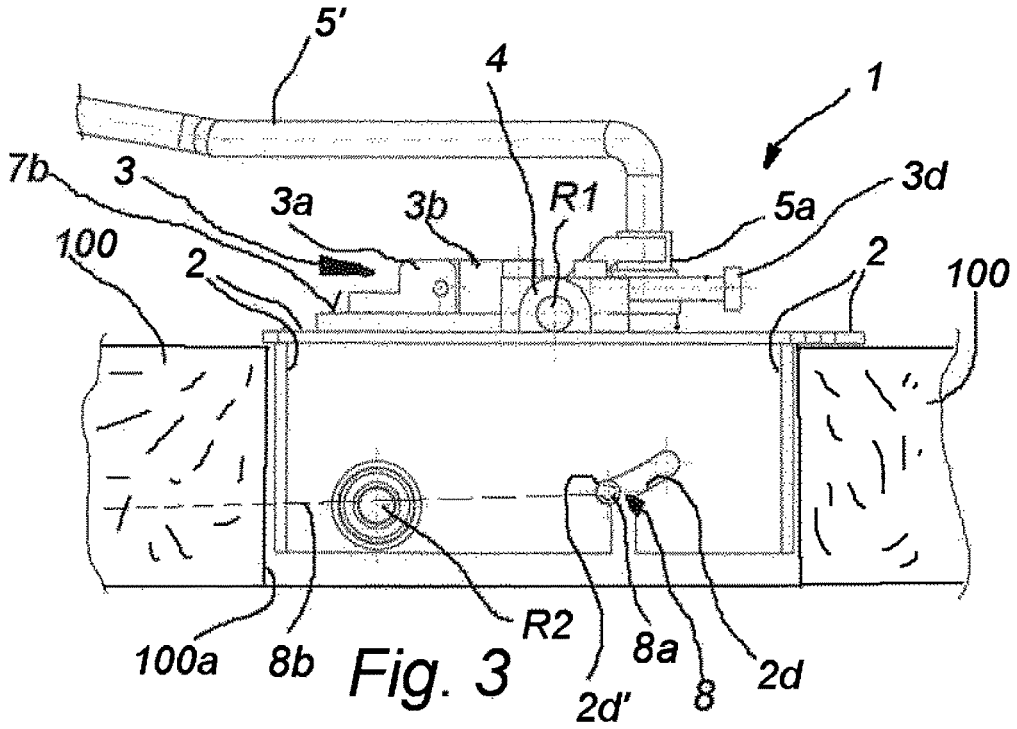
Figure 4:
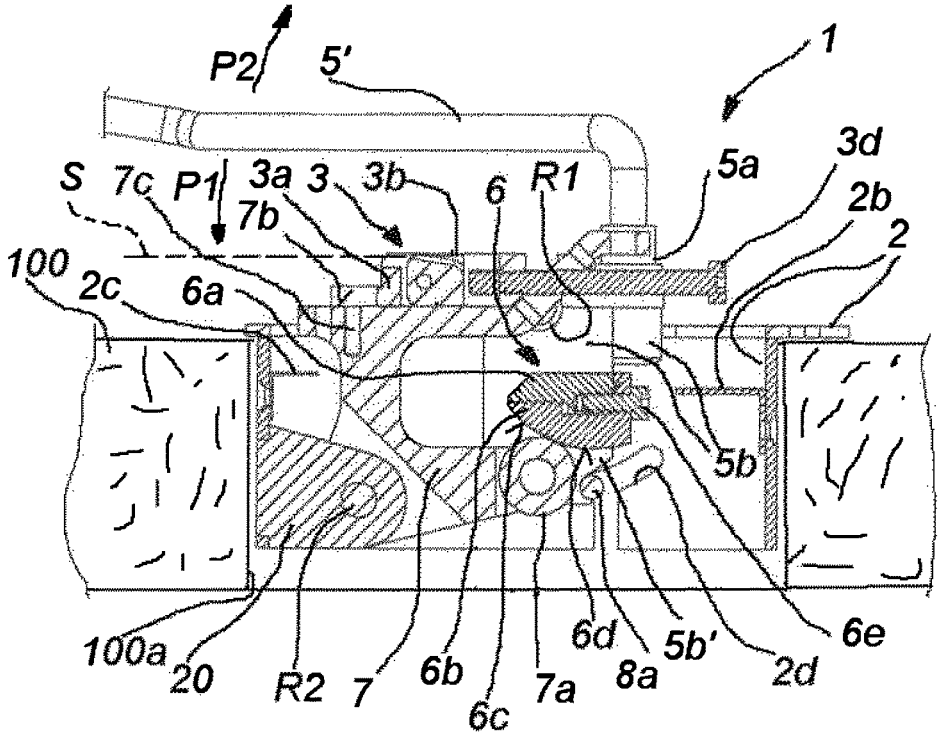
Figure 5A:
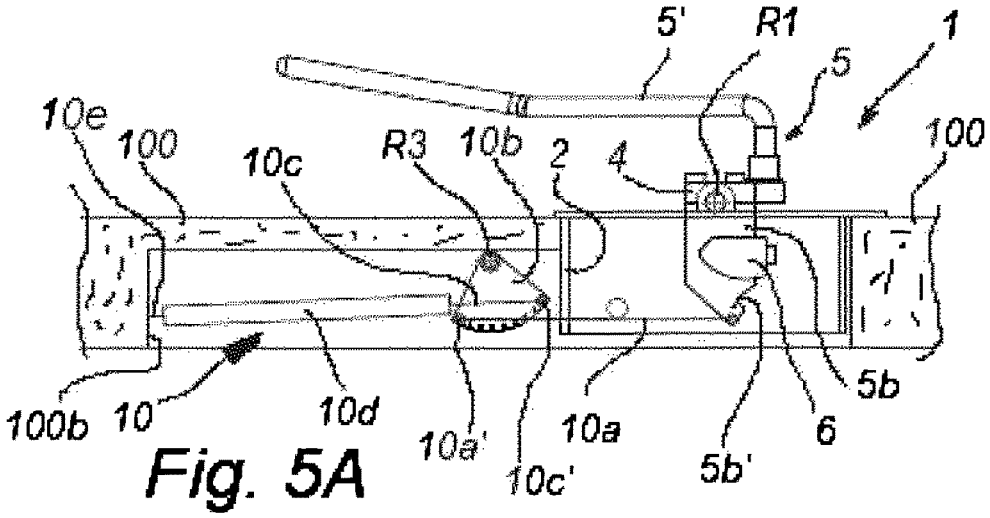
Figure 5B:
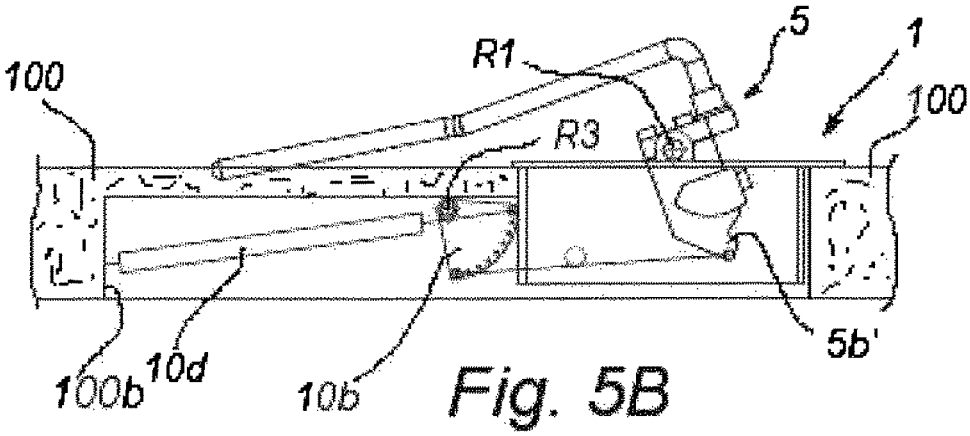
Figure 5C:
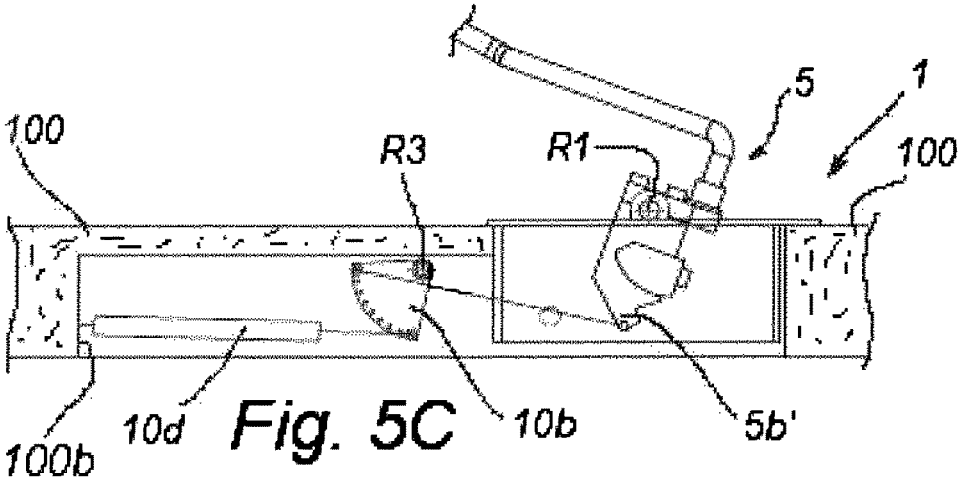

The invention is described in greater detail in the following, with reference to the accompanying drawings, of which:

FIG. 1 shows a top view of a bridge body applying the attachment arrangement for the strings of a stringed instrument according to a preferred embodiment of the invention, and of the lever means relating to it, FIG. 2 shows the bridge body of FIG. 1 from below, FIG. 3 shows a side view of the bridge body of FIG. 1, FIG. 4 shows a section of FIG. 1 along line IV-IV, and FIGS. 5A-5C show a counter-spring arrangement according to a preferred embodiment of the invention.

FIGS. 1 to 4 thus show an attachment arrangement for a stringed instrument according to a preferred embodiment of the invention. FIGS. 1, 3 and 4 show a part of the body of a stringed instrument marked with reference numeral 100. Here, the stringed instrument is an electric guitar, in the opening 100*a* formed in the body 100 of which the bridge body 2 according to the invention, second restraining means 3, moving means 6, 7 and lever means 5 for moving the second restraining means 3 are fitted. It should be noted that in these Figures, the attachment arrangement is shown in its normal position. The structure of these parts is described in greater detail in the following.

The Figures thus show the body 100 of a guitar in which is made an opening 100*a* passing through the body 100. In the opening 100*a* is fitted a bridge body 2 comprising side flanges parallel to the surface of the guitar body 100, the lower surfaces of the flanges resting against the surface of the guitar body 100 from the edge of the opening 100*a*. In the bridge body 2 are preferably arranged holes 2*a*, openings or the like for attachment means, such as screws (not shown). By means of these attachment means, the bridge body 2 can be attached so as to be immobile on the body of the instrument 100 and so that it can be detached from its attachment if necessary. In the centre of the bridge body 2 is an opening which corresponds in shape to the opening 100*a* of the body 100. The bridge body 2 comprises walls extending from the edges of the opening, which can be fitted into the opening 100*a* of the body 100. The walls are in this case preferably located adjacent to the surfaces (transverse with respect to the surface of the body 100) of the opening 100*a*. The above-mentioned attachment means of the bridge body may also be of the type by means of which the position of the bridge body in the direction of the depth of the opening 100*a* of the body 100 is adjustable. The walls of the bridge body 2 may comprise protective projections, such as 2*b* and 2*c*, which prevent the falling or penetration of dirt and larger inappropriate objects into the opening 100*a*.

In conjunction with the bridge body 2 are located lever means 5 which form an element turning with respect to the bridge body 2. The lever means 5 comprise a lever 5' which can be fitted in a manner known as such to a seat 5*a* or similar attachment means. The seat 5*a* with its lever 5' is attached to a support element 5*b* arranged to turn with respect to the bridge body 2. On the opposite side of the bridge body 2 is a second support element 5*b*. The support elements 5*b* are arranged to turn through bearing means 4. The bearing means 4 include pivoted axles R1 attached to the bridge body 2, which are arranged to extend in conjunction with the bearing means 4 fitted in a housing formed by the upper part of the support elements 5*b* and to thus cooperate with them. The attachment means 4 are arranged on opposite edges of the opening of the bridge body 2. Here, the upper part of the support elements 5*b* is made to be openable, which makes it possible to mount the bearing means 4 and to fit the pivoted axles R1 in conjunction with the bearing means 4. The longitudinal direction of the pivoted axle R1 is preferably perpendicularly transverse to the longitudinal direction of the strings S of the instrument and it is preferably located in the vicinity of the plane passing through the strings S. Due to the location of the pivoted axle R1 and the seat 5*a*, the attachment point of the lever with respect to the strings S is preferably very close to the attachment point on a Floyd Rose bridge, which means that the lever 5' can be similar to that on a Floyd Rose bridge. The use, and also the appearance, of the bridge are thus familiar to those accustomed to the Floyd Rose bridge. The attachment point (seat 5*a*) of the lever 5' may, if so desired, be changed to a location differing from the customary one.

The seat 5*a* is attached to a support element 5*b* or the like located in the vicinity of the edge of the opening 100. FIG. 2 shows that a similar support element 5*b* is arranged on the opposite edge of the opening 100*a*. The support elements 5*b* turn with the seat 5*a*. In conjunction with the lower edge 5*b*' of the support elements 5*b* is provided an attachment point for at least one or more counter-springs. A preferred embodiment of a counter-spring is shown more closely in FIGS. 5A to 5C and described in greater detail below.

Therefore, in the space between these two support elements 5*b* are fitted especially the moving means 6, 7 according to the invention, shown in FIGS. 2 and 4. They preferably include a formed element 6 fitted between the two support elements 5*b* and turning with them. The formed element 6 is preferably comprised of adjacent formed pieces 6*b*, of which there are preferably as many as there are strings in the instrument, and of a bridge piece 6*a*. Each individual formed piece 6*b* is located in a transverse direction with respect to the longitudinal direction of the strings, at each string, respectively. Here there are six formed pieces 6*b* and they have a cross-sectional shape of a cam. The formed pieces 6*b* are preferably arranged to turn with the support elements 5*b* (around the pivoted axle R1) in conjunction with a bridge piece 6*a* arranged between the support elements 5*b* and connecting the support elements 5*b*. Each formed piece 6*b* is preferably removably attached to the bridge piece 6*a*, for example by means of a retaining screw 6*e*. The formed element 6 may also be a single part to which the formed pieces 6*b* are machined, or the formed pieces 6*b* may form a uniform piece which is attached to the bridge piece 6*a*. In a preferred embodiment, each formed piece 6*b* is detachable and attachable and can, therefore, be replaced without dismantling it and altering its adjustments.

Each formed piece 6*b* is connected to an individual moving mechanism 7 in a corresponding position, as described below. The moving mechanism is comprised of the pivot links 7 shown in FIG. 4, having the shape of a letter U turned on its side, which are arranged to turn independently of one another around a common axle passing through a second pivoted axle R2 formed in conjunction with the bridge body 2 in accordance with the turning movement brought about by the formed pieces 6*b*. The longitudinal direction of also the second pivoted axle R2 is preferably perpendicularly transverse to the longitudinal direction of the strings S of the instrument and it is located at a distance from the pivoted axle R1, in the lower part of the pivot link 7 (as shown in FIG. 4). The pivoted axle R2 is, therefore, located at a distance below the plane passing through the strings S (as shown in FIG. 4). The pivoted axle R2 is mounted on lugs 20 provided in conjunction with the wall of the bridge body 2, of which each individual lug 20 is designed to receive the slot-like counterpart formed in the lower part of the pivot link 7. Each pivot link 7 may alternatively also be arranged to turn around its own pivoted axles located at different distances from the attachment points or the strings. If so desired, in each pivot link 7 may be included a separate auxiliary spring (not shown) which ensures the turning of the pivot link even after the string has become so loose that it no longer has sufficient force to turn the pivot link.

The upper part of each pivot link 7 included in the moving mechanism is designed to receive the restraining means 3. The design may be, for example, a flat upper surface 7*b* of the pivot link, as shown in FIG. 4, to which a restraining piece 3*a* comprised in the restraining means may be attached at different distances by means of a mechanical attachment means, which makes possible minor adjustment of the length of each string, that is, the intonation of the instrument. This type of attachment means is, for example, a small screw, which is passed through a slot in the restraining piece 3*a* to the threaded bore 7*c* of the pivot link 7. The restraining piece 3*a* has a slot into which a fine-tuning piece 3*b* is articulated. The other end of the string is fitted and tightened by means of a clamping screw 3*d* to the fine-tuning piece 3*b*. Thus, the end area of one end of each string S remains above the restraining means 3 of the corresponding pivot link 7. The first ends of the strings (not shown in the Figures) can be restrained to a lock saddle located adjacent to the front end of the neck by means of a restraining mechanism known as such. By changing the position of the fine-tuning piece 3*b* in the slot of the restraining piece 3*a*, for example by means of a screw mounted to the end of the pivot link 7 and pressing down the clamping screw 3*d* (not shown), the tune of the restrained strings can be fine-tuned. Thus, the vibrating section of the string S remains between the edge of the restraining mechanism and the edge of the fine-tuning piece 3*b* and the string is restrained specifically at the ends of the vibrating section, because at both ends the distance from the edge supporting the string to the actual restraining point is practically insignificant. The structure can also be realised without a separate fine-tuning piece, in which case the possibility of fine tuning can be eliminated or realised in conjunction with the restraining of the front end of the neck. Since the structure allows the strings S to be let completely loose by turning the lever 5', the conventional tuners on the headstock of the neck, or even the entire headstock, may be eliminated if so desired, because the string can be attached when the lever is in a suitable position and tuned with a fine tuner after the release of the lever. To facilitate this can be made, for example, a piece to be placed between the backwards turned lever and the body of the instrument, which lifts the lever into the correct position for mounting the strings. The restraining means 3 connected to the pivot link 7 moves with the corresponding pivot link 7, thus loosening and/or tightening the string S attached to the restraining means. In the following is described in greater detail, with reference to FIGS. 2 and 4, the detailed structure and functioning of the formed elements 6 and pivot links 7 according to the invention in a preferred embodiment.

Transversely between two support elements 5*b* are thus fitted formed pieces 6*b*. A single formed piece 6*b* preferably comprises a body through which the formed piece 6*b* can be connected by means of a screw 6*e* to the bridge piece 6*a*. The cam-like formed piece 6*b* comprises a contact surface which is divided into parts 6*c* and 6*d* in the description. When the restraining means are in their normal position, the point of connection of these parts is in contact with the counterpart 7*a* of the pivot link 7. The contact surface is preferably arranged to move against a counter-roll or other counterpart 7*a* located in the lower part (tip of one of the U branches) of the U-shaped pivot link 7. FIG. 4 shows the normal position of the attachment arrangement, where the lever 5' is neither pressed nor lifted. In this case, the exemplary linear point of contact between the contact surface of the formed piece 6*b* and the counter-roll 7*a* shown in FIG. 4 divides the contact surface into a first surface segment 6*c* and a second surface segment 6*d*. At the same time, the restraining means 3 are in their normal position.

When the lever 5' is pressed in accordance with arrow P1 (FIG. 4) towards the body 100 of the instrument, the lever means 5, and thus also the formed element 6, turn anti-clockwise around the pivoted axle R1 (FIG. 4). As a result, the counter-roll 7*a* of each individual pivot link 7 rolls along the first surface segment 6*c* of each corresponding individual formed piece 6*b* of the formed element 6. The surface segment 6*c* is designed in such a way that each pivot link 7 with its corresponding restraining means 3 is able to turn by the effect of the tractive force generated by the strings S (to the left in FIG. 4) anti-clockwise around a second pivoted axle R2 (as shown in FIG. 4). The pivot links 7 are here arranged to turn around a common axle R2. Thus, the length of the sounding section of the string S shortens, which temporarily loosens the tension of the string. Similarly, when the lever 5' is lifted in accordance with arrow P2 away from the body 100 of the instrument, the lever means 5, and thus the formed element 6, turn clockwise around the pivoted axle R1 (FIG. 4). As a result, the counter-roll 7*a* of an individual pivot link 7 rolls along the second surface segment 6*d* of each corresponding individual formed piece 6*b* of the formed element 6, whereby the formed piece 6*b* exerts a force on the pivot link 7 which moves (turns) it. In this case, each pivot link 7 with its corresponding restraining means 3 has to turn clockwise around the second pivoted axle R2. Thus, the length of the sounding section of the string S increases, which temporarily tightens the tension of the string S. When the lever is released, the lever means 5, the formed element 6 and the moving means 7 with the restraining means 3 automatically return to the original normal state, which the strings S and the return and counter-spring mechanisms (disclosed in greater detail below) bring about.

The purpose of the surface segments 6*c* and 6*d* of an individual formed piece 6*b* is in this embodiment to effect the individual movement of the corresponding pivot link 7 and thus of the restraining means 3 of the string, which is independent of the movements of the other pivot links 7 and thus of the other attachment means 3. The individual movement of the attachment means 3 of the string (which corresponds to the change in the length of the free section of string S) with respect to the movement of the lever means 5 (P1 and P2) is effected by at least the individual surface profile of the surface segments 6*c* and 6*d* of each formed piece 6*b*. The surface profiles for each surface segment 6*c* and 6*d* can be selected, for example, in such a way that the pitch of the strings changes when the lever 5' is turned (tightening and loosening of the strings) to the same or essentially the same extent. This is not possible in the prior art string attachment arrangements with double restraining of the strings. The surface profiles of the surface segments 6*c* and 6*d* may, in principle, be selected as desired and the individual profiles of the surface correspond to the change in the pitch of the string S attached to the corresponding attachment means 3. For example, in a six-string guitar, the two thinnest strings can be provided with formed pieces 6*b*, by means of which are achieved changes in the pitch of the strings which correspond to one another when the lever 5' is used. The following four strings can be divided in a corresponding manner into two sets of two strings.

The shape of the surface segments 6*c* and 6*d* of an individual formed piece 6*b* can be selected and manufactured by machine, for example, on the basis of one of the following parameters or their combination: string tension, frequency of the sound formed by the string, location of the restraining means at least in the longitudinal direction of the string, turning angle of the lever means 5 around the pivoted axle R1. Other parameters may also be used. All these parameters can be determined when the basic structure of the attachment arrangement 1, such as the positions of the pivoted axles and the shape of the counterpart 7*a* of the pivot link 7, are known. The contact surface of the formed piece 6*b* may be a part of the circular arch, whereby the desired movement of the attachment means 3 of the string determines the location of the diameter and the centre of the circle. This simple counter-surface and the entire formed piece are easy to dimension with the design program (cad) of a computer once the desired location of the attachment means 3 in the normal and extreme lever positions is determined. Such formed pieces are easy to dimension, manufacture and sell for all customary tightening and loosening distances of strings, for example with 0.25 mm spacing, whereby the player is fairly easily able to change the pitch of the strings in essentially equal proportion or to provide some other desired function. On the other hand, for example, the computation programs of the camshafts of combustion engines can be utilised even for providing extremely complex string tightening and loosening profiles. It is also possible to make a narrow sector by the normal position, where the contact surface of the formed piece 6*b* is at a constant distance, or almost constant distance, from axle R1 of the lever means 5, and in this case it is also possible to realise the construction only by means of the centering spring or other centering means of a simple lever means 5.

Furthermore, the individual movement of the attachment means 3 (for example, a change in its height with respect to the body 100) can be changed by designing or dimensioning the pivot link 7 in addition to or instead of the designing of the surface segments, especially if each pivot link 7 is provided with an individual pivoted axle R2.

In a preferred embodiment of the invention, the string attachment arrangement is preferably provided with the counter-spring mechanism shown in FIGS. 5A-5C, or a similar mechanism 10. The purpose of this is to facilitate the use of the lever means and further to improve the operation of the moving means 6 and 7 according to the invention. It should be noted that the counter-spring mechanism of FIGS. 5A-5C and that described in the following may be applied to a prior art bridge arrangement, such as that known from the patent publication U.S. Pat. No. 4,497,236. A particular aim is to control the force affecting the moving means of the counter-spring in such a way that the force does not increase rapidly when the strings are loosened, nor decrease rapidly when the strings are tightened. FIG. 5A shows a string S attachment arrangement in the normal position (in equilibrium), where a counter-spring mechanism marked with reference numeral 10 is preferably arranged on the lower edge 5*b*' of one support element 5*b*. The counter-spring mechanism 10 can also be arranged in connection with the other, opposing support element 5*b*. The structure differs from the conventional solution in that the counter-springs, which are marked with reference numeral 10*d*, do not effect the turning part (moving means) directly, but through the rocker element or rocker arm 10*b* forming the lever arm. In addition to this, the counter-spring mechanism 10 is located in the longitudinal cavity 100*b* or the like of the instrument body 100, which is located, differing from prior art solutions, to the side from the line of the body 100 defined by the strings S. In this way, the thinning of the material thickness of the body 100 is avoided at a disadvantageous point immediately by the strings S.

Here, a single counter-spring 10*d* is fixed from its first end preferably to an adjustable holder 10*e* provided on the edge of a longitudinal cavity 100*b* or the like formed in the body 100 of the instrument. From its other end, the counter-spring 10*d* is fixed to a rocker element or corresponding rocker arm 10*b*, which is in this embodiment arranged in the longitudinal direction of the strings of the instrument between the counter-spring 10*d* and the support element 5*b*. FIG. 5A shows a rocker arm 10*b* which is a fan-like or sector-like rocker arm arranged to turn around a pivoted axle R3. The rocker arm may also be, for example, triangular or the shape of an inverted letter V. The pivoted axle R3 is arranged within the area of the tip of the sector-like rocker arm 10*b*. In addition to this, the pivoted axle R3 is preferably parallel to pivoted axles R1 and R2, but may differ from this and be, for example, perpendicular to the plane formed by the strings S (vertical in FIG. 5A). In this case, the rocker arm may also be circular. The rocker arm 10*b* is provided with at least two attachment points, in which the counter-spring 10*d* is fixed through the attachment wire 10*c* of the other end to the attachment point 10*c*' of the rocker arm 10*b* located closer to the support element 5*b*. To the lower edge 5*b*' of the support element 5*b* is connected an inelastic or essentially inelastic draw wire 10*a* or the like, one end of which is taken to the second attachment point 10*a*' of the rocker 10*b*, which is located further from the support element 5*b*. There may be even more counter-spring mechanisms, for example two. In that case, the counter-spring mechanism 10 is arranged in both of the support elements 5*b*. In the sector-like rocker arm 10*b* are arranged, at evenly spaced intervals on the arc of the sector, attachment holes for fixing the counter-spring 10*d* and the draw wire 10*a* to different points on the rocker arm 10*b*. This makes possible placing the counter-spring 10*d* and the draw wire 10*a* in appropriate positions from the point of view of the functioning of the attachment arrangement 1. The tension of the counter-spring may be adjusted with the adjustable holder 10*e*, if necessary. The adjustable holder 10*e* may be, for example, a screw-like means in the body 100 of the instrument, by turning which the tension of the counter-spring 10*d* changes. There may be one or more adjacent counter-springs.

When looking at FIG. 5A, it is noted that the counter-spring 10*d* and the draw bar 10*a* are essentially on the same line, whereupon the force of the spring is exerted on the lever means 5 of the bridge by essentially the same force as in prior art constructions, where the counter-spring is attached directly to the turning part of the bridge.

In FIG. 5B, the lever means are turned into a position where the strings S are temporarily loosened. In the rocker arm 10*b*, its axle R3 and the attachment point of the counter-spring 10*d* are on the same or at least almost on the same line. The lever arm of the counter-spring 10*d* is in this case short and the torque generated by the tightened counter-spring 10*d* is thus low. The force of the counter-spring 10*d* is exerted essentially on the axle R3 of the rocker arm 10*b*. From FIG. 58 can be seen that, at the same time, the draw wire 10*a* or the like is again essentially perpendicular to the straight line passing through its attachment on the rocker arm 10*b* side and the rocker arm axle R3 (on the vertical line in FIG. 5B), while the lever arm is essentially at its maximum. From this follows that, although the turning force exerted by the strings S on the lever means 5 has been reduced to a very low level, the lever means 5 can be turned to the position shown in FIG. 5B with little force.

In FIG. 5C, the lever means 5 are turned into a position in which the strings S are temporarily tightened. In the rocker arm 10*b*, its axle R3 and the attachment point of the draw wire 10*a* are on the same or at least almost on the same line. The lever arm of the draw wire 10*a* is in this case short. The draw-spring 10*d* is in turn essentially perpendicular to the straight line passing through its attachment on the rocker arm 10*b* side and the rocker arm 10*b* axle R3 (on the vertical line in FIG. 5C), while the lever arm of the counter-spring 10*d* is essentially at its maximum. From this follows, in turn, that although the force exerted by the strings S on the lever means 5 has increased, for example doubled compared to the central position (normal position), even with slightly loosened counter-springs 10*d*, the lever means 5 can be turned into the position shown in FIG. 5C with little force. It can be said that the foregoing counter-spring mechanism 10 according to a preferred embodiment of the invention evens out and reduces, with respect to prior art, the force with which the lever 5' driving the lever means is used, whether it is used in either direction for tightening or loosening the strings S. The use of the entire attachment arrangement 1 according to the invention is, therefore, easier and more accurate.

The counter-spring mechanism may, therefore, differ structurally from the foregoing and be, for example, such that the positions of the counter-spring and the rocker arm with respect to one another are interchanged. In this case, the counter-spring is implemented as a functionally pushing pressure spring. If the pivoted axle R3 of the rocker arm or a corresponding circular element is perpendicular (vertical in FIG. 5A) to the plane defined by the strings S, the tractive counter-spring 10*d* can be directed more freely, for example, in such a way that the counter-spring 10*d* is alongside the draw wire 10*a* and its holder 10*e* is adjacent to the bridge body 2. The essential aspect is the formation of a lever arm (arms) constituted by the rocker arm or the like, by means of which is compensated for the increase in the tractive force exerted by the strings S and the counter-spring 10*d* on the lever means 5.

The invention can also be implemented with one or more tractive counter-springs, without a rocker arm or the like, in which case its feel in use is very similar to a Floyd Rose bridge. A simple counter-spring mechanism 10 actually only comprises a counter-spring 10*d* and its adjustable holder 10*e* and possibly a draw wire 10*a* for connecting the end of the spring to the lever means 5.

FIGS. 2 and 3 show yet another preferred embodiment of the invention, where the lever means 5 are provided with a separate return mechanism 8. Its function is especially to ensure the return of the attachment arrangement 1 precisely into the normal position, at least once the lever part 5' (and thus the lever means 5) has been released from its downwards pressed position S1. The return mechanism 8 comprises a pin 8*a* or the like fitted to move in slots 2*d* in the opposite side walls of the bridge body 2, the pin being arranged in its longitudinal direction to be parallel with the pivot axle R1. In designing the slots 2*d*, it is important that the pin 8*a* moves freely in them, but settles in its correct position when it is pulled by the spring or springs against the counter-surfaces 2*d'* formed by the ends of the slots (in FIGS. 3 and 4 the left ones). The pin 8*a* thus extends into the area extending between the side walls of the bridge body 2 and, if necessary, through the slots 2*d* by a distance outside the side walls. It is preferable for the end area of the pin 8*a* to be of a flexible material or coated with a flexible material, in order that the encounter between the pin 8*a* and the bridge body 2, and on the other hand of the pin 8*a* and the support elements 5*b*, does not generate sound and/or vibration.

On the lower edge 5*b'* of the support elements 5*b* are provided formed parts by means of which they settle by the effect of the tractive force of the strings S against the pin 8*a* in a transverse or essentially transverse direction with respect to the longitudinal direction of the pin 8*a* (see FIG. 4). By means of the form of the lower edge 5*b'* of the support elements 5*b*, the pin 8*a* remains, during its movement, also in the centre part of the slots 8*d* and does not, therefore, rub on the edges of the slots. A counterforce to the tractive force of the strings is preferably provided by arranging a return spring or return springs or corresponding counterforce elements 8*b* in at least one end area of the pin 8*a*. The other end of the return spring 8*b* is in turn fixed, preferably in a similar manner as the counter-springs 10*d*, on the edge of a second longitudinal cavity 100*b* formed in the body 100 of the instrument or to an attachment point arranged in the longitudinal cavity, which may also be provided with the adjustment means of the counterforce element 8*b* (not shown). The second longitudinal cavity 100*b* is arranged on the opposite side of the strings S than the longitudinal cavity intended for the counterforce mechanism 10. Should the pin 8*a* extend by a distance outside the side walls of the bridge body 2, the return spring or return springs can also be located outside the line of the side walls of the bridge body, whereupon the counter-spring mechanism 10 can be located more freely and/or there may be counter-springs 10*d* functioning over the entire distance of travel on both sides of the bridge.

Thus, the lever means 5 are effected by the forces generated by the counter-spring mechanism 10 and the return mechanism 8. The distribution of these forces is preferably selected in such a way that 90-75% of these forces are generated by the counter-spring mechanism 10 and 10-25% of these forces are generated by the return mechanism 8. These forces may be proportioned to the opposite forces generated on the lever means 5 through the formed element 6 of the springs S and the moving means 7. This setup ensures above all that at least the breaking of one string S, which typically corresponds to a decrease of 12-18% in the counterforce generated by the strings, will not affect the tuning of the other strings S. In other words, the position of the lever means 5, the formed element 6 and the moving means 7 remains unchanged in their normal position. An advantage of this compared to the prior art solutions is that playing with the instrument can be continued with the remainder of the strings S. Even a smaller proportion of the force of the return mechanism suffices to maintain the pitch of the other strings unchanged when the player changes the pitch of a string by moving it with a finger in the direction of the fingerboard frets, so-called bending. With prior art instruments, either a fixed-bridge or a floating-bridge guitar has to be selected, or both; the solution according to the invention combines the best properties of both in the same instrument, which means that they can be utilised in the same playing session and one good instrument is enough.

The purpose of the return mechanism 8 is to provide, together with the counter-spring 10*d*, at least the type of force where the joint force of the counter-springs 10*d* and the return mechanism 8 turning the lever means 5 is greater than the turning force of the strings S (in the opposite direction), whereby the pin 8*a* always rests against the end (counter-surface 2*d'*) of the slot 2*d* in the normal position of the attachment arrangement 1 (see FIGS. 3 and 4, in them the left end of the slot). By adjusting the tension of the return mechanism and the counter-spring, the player will be able to seek the specific combination of properties and feel which he finds best for himself/herself.

Structurally, this type of attachment arrangement allows a single string or several strings to be rapidly tuned up to a raised or dropped tune, because due to the structure, it is not necessary to search for a common state of equilibrium for all. For example, the often used so-called drop tuning, where the pitch of the thickest string is lowered by one interval while the tuning of the other strings remains the same, can be done by adjusting the tension of only this string, either by means of a tuner, a fine tuner or a separate mechanism installed for this purpose, and returning to standard tuning is equally easy.

In preferred embodiments of the invention, the strings are restrained at both ends of the sounding part in such a way that in connection with the restraining point is formed a non-sounding section at most of an insignificant length, in which case there are no separate slots or grooves in the structure from which the strings could come out when they loosen, and in which case the instrument returns precisely into tune when the bridge mechanism returns to its normal position. In connection with this type of restraining, practical fine-tuning can be implemented either in the restraining means 3 comprised in the bridge or in the lock saddle at the front end of the neck of the instrument. The intonation of the string, that is, the fine-tuning of its length, is done by moving the restraining means 3 along the surface of the pivot link 7 essentially parallel to the string. Since the structure of the bridge makes it possible to render all strings S completely loose by deviating the lever 5', the conventional tuners on the headstock of the instrument, or even the whole headstock, can be eliminated, and the bridge can be set in a string-changing position, for example, by placing a piece of suitable height between the lever 5' turned back and the body 100 of the instrument. Each string S is attached at its bridge-side end by means of the restraining means 3 to a pivot link 7 turning around its axle R2, the change in the position of which changes the length of the string attached to it and thus also the tension and pitch. The tractive force caused by the tension of the string and the force of the possible auxiliary spring connected to the pivot link 7 is exerted on the pivot link 7, pulling it in a direction loosening the string. The lever 5' is comprised in the lever means 5 which are mounted on bearings to turn around their axis R1. With the lever means turns a formed element 6, including typically one separate and separately exchangeable formed piece 6*d* per each pivot link 7 which corresponds to the counterpart 7*a* at the end of the pivot link 7. The spring forces resisting the tractive force caused by the strings S and the force of the auxiliary spring possibly connected to the pivot link 7 are exerted on the lever means 5. These forces are preferably generated by two parts: the return mechanism 8, which aims to return the lever means 5, and through them the entire mechanism, to its normal position when the lever 5' is released after having been pressed P1 downwards and which does not tend to pull the lever means 5 further than to the normal position in the string-tensioning direction, but stops at this point against the counter-surface included in or attached to the bridge body 2, and by a counter-spring mechanism 10 which acts over the entire turning distance of the lever means, attempting to pull the lever means in the string-tensioning direction. The forces parallel to the tractive force of the strings S exerted on the pivot link 7, and the forces opposite to them exerted on the lever means 5, press the counterparts 7*a* at the ends of the pivot links 7 towards the contact surface of the formed pieces 6*d* connected to the lever means, and the distribution of forces in this manner makes the mechanism free from play. The joint force of the return mechanism 8 and the counter-spring mechanism 10 is adjusted to be so great that while the lever 5' is free, the return spring mechanism 8 meets its counter-surface connected to the bridge body 2 and the entire bridge mechanism in its normal position. By means of the shape of the contact surface of the easily exchangeable formed piece 6*b* is directly affected how the turning angle of the pivot link 7 corresponding to it and the tension of the string S attached to the pivot link 7 change when the lever 5' is deviated from its normal position, and due to this, each string can be provided with a pitch changing profile according to the wishes of the player. The return mechanism 8, the counter-spring mechanism 10 or both may be implemented by utilising a rocker arm 10*b* turning around its axle R3, or a corresponding element which, when turning, when deviating the lever 5' in the downward direction P1, the lever arm of the draw wire or the like between the rocker arm and the lever means 5 lengthens and/or the lever arm of the spring connected to it shortens, and which, when turning, when deviating the lever 5' in the upward direction P2, the lever arm of the draw wire or the like between the rocker arm and the lever means 5 shortens and/or the lever arm of the spring connected to it lengthens, whereby the use of the lever 5' and of the entire mechanism becomes lighter and the feel improves. By adjusting forces and relative forces of the return mechanism 8 and the counter-spring mechanism 10 can be sought a combination of precisely the properties and feel which the player finds best for himself/herself. In general, a good starting point is that the return mechanism 8 produces about 20% of the overall force required, whereby the feel is good when moving in one direction or the other from the normal position and yet the remaining strings of the instrument remain in tune even when one string breaks. A larger proportion of the overall force of the return mechanism 8 allows, for example, several strings to be broken without the tuning of the remaining strings changing. Then again, it has been found that even a smaller proportion of the overall force of the return mechanism 8 is sufficient, for example, for the pitch of the other strings not to change, when one or more of the strings are slid in the direction of the frets of the fingerboard, that is, transversely, to heighten their pitch (so-called bending). Furthermore, the tuning of the lowest string can be changed to one interval lower (so-called drop tuning) or back without other adjustments or changing the tuning of all strings is easy and quick.

In preferred embodiments of the invention, the return mechanism 8 and the counter-spring mechanism 10 are mounted on the sides with respect to the strings S, in such a way that the cavities needed for them in the body 100 of the instrument are not under the strings, whereby the body and the structure of the instrument is as strong as possible in the area between the neck and the bridge. In addition to this, the bridge body 2 is preferably mounted in a hole 100*a* made in the body 100 of the instrument in such a way that the front edge of the bridge body 2, to which the lugs 20 of the pivot link 7 are attached, rests against the corresponding edge of the hole 100*a* in the body of the instrument. In this case, the instrument produces a strong and pure tone and good sustain, that is, if desired, sounds sound for a long time after twanging.

Many of the advantages of the invention can also be achieved even when each string does not have its own pivot link 7, but several strings are attached to a joint pivot link. Already three pivot links positioned in such a way that the thinnest and thickest string have their own pivot links and the centremost strings have one joint pivot link is a noteworthy alternative. In an extreme case, there may be one joint pivot link for all strings.

The solution according to the invention can also easily be equipped with an electronic control device, such as a potentiometer, the signal of which changes as the tension of the strings S changes. This type of control device can be connected, for example, by means of draw wire or both a pulling and pushing wire either to the lever means 5, the moving means 7 or the rocker arm 10*b*. By means of the control device, for example, a special effect can be controlled to change its form in accordance with the use of the lever 5'. This type of special effect may be, for example, a light effect mounted either on the instrument itself or outside it, the brightness and/or colour of which may change as a function of turning the lever. This type of control device mechanism could also be applied to other moving bridge constructions.

In a preferred embodiment of the invention, the lever 5' is located practically at the same point with respect to the strings S and the entire instrument as the lever of a Floyd Rose bridge controlling non-fixed bridges, which means that the lever can be exactly the same and in the same location and thus familiar to the players. The path of the lever can also be made similar, or essentially similar, to that in a Floyd Rose bridge. Furthermore, it is possible to make the appearance of the entire bridge very similar to the well-known and generally accepted appearance of a Floyd Rose bridge.

In a preferred embodiment of the invention, it is possible that the draw wire (wires) 10*a* of the counter-spring arrangement 10 shown, for example, in FIGS. 5A-5C, is connected to the pin 8*a* of the return mechanism 8 instead of to the lower edge 5*b*' of the support element 5*b*. In this case, the counter-spring arrangement 10 with its counter-springs 10*d* functions at the same time as the return springs or similar counterforce elements 8*b* of the return mechanism, whereby the separate counter-force elements of FIGS. 2 and 3 are not needed. The return of the attachment arrangement 1 to the normal position following the temporary tightening of the strings (when the lever is turned upwards P2) takes place by the effect of the tractive force of the strings S.

The present invention is not limited merely to the embodiments shown, but may be applied in various ways within the scope of protection defined by the claims.

The invention claimed is:

1. An attachment arrangement for strings of a stringed instrument, comprising:

a bridge body fixed to a body of the stringed instrument, first restraining means for restraining the strings from a first end area, one or more second restraining means arranged with the bridge body for restraining the strings from a second end area, lever means arranged with the bridge body for moving the second restraining means for temporarily loosening and/or tightening the strings by means of a lever part included in the lever means, wherein the lever means comprise moving means having at least one moving mechanism which is separate from the lever means and which is arranged with the one or more second restraining means to move with respect to the bridge body, and wherein the moving means are arranged to transmit a movement of the lever means into a movement of the one or more second restraining means.

2. The attachment arrangement according to claim 1, wherein the one more second restraining means are arranged to move independently with respect to one another, and wherein each moving mechanism is connected to a corresponding second restraining means in order to move each corresponding second restraining means independently of one another.

3. The attachment arrangement according to claim 1, wherein the lever means is arranged to turn through a bearing means arranged with the bridge body around a pivoted axle transverse with respect to a longitudinal direction of the strings.

4. The attachment arrangement according to claim 1, wherein the moving means include a formed element comprising formed pieces for each of the at least one moving mechanism for transmitting a turning movement of the level means into an individual movement of each of the at least one moving mechanism.

5. The attachment arrangement according to claim 4, wherein each formed piece comprises contact surfaces in contact with a corresponding counterpart of the at least one moving mechanism.

6. The attachment arrangement according to claim 5, wherein the corresponding counterpart is a counter-roll against which the contact surfaces of each formed piece are arranged to roll and/or slide.

7. The attachment arrangement according to claim 4, wherein the formed pieces are arranged to turn with the lever means around a pivoted axle.

8. The attachment arrangement according to claim 1, wherein at least two moving mechanisms are arranged to turn around a second common pivoted axle formed for the at least two moving mechanisms in conjunction with the bridge body.

9. The attachment arrangement according to claim 1, wherein the at least one moving mechanisms is arranged to turn around a second pivoted axles formed for the at least one moving mechanism in conjunction with the bridge body.

10. The attachment arrangement according to claim 4, wherein the formed element further comprises a bridge piece, and wherein the formed pieces are removably attached to the bridge piece.

11. The attachment arrangement according to claim 1, further comprising one or more counter-spring mechanisms provided with a rocker arm arranged to turn around a pivoted axle of the one or more counter-spring mechanisms, and which is provided with at least two attachment points, and wherein one of the at least two attachment points is connected to a draw wire or draw bar connected to the lever part, and wherein one of the at least two attachment points is connected to a counter-spring.

12. The attachment arrangement according to claim 11, wherein the at least two attachment points of the rocker arm are located on opposite sides of a line passing through the pivoted axle of the one or more counter-spring mechanisms substantially perpendicular to a longitudinal direction of the strings when the attachment arrangement is in a normal position.

13. The attachment arrangement according to claim 1, wherein the lever means is provided with a return mechanism such that the lever means can be automatically returned to a normal position at least after temporary loosening of the strings.

14. The attachment arrangement according to claim 13, wherein the return mechanism comprises a pin fitted to move in elongated slots made in opposite side walls of the bridge body, wherein against said pin support elements rest due to a tractive force of the strings, and wherein at least one counterforce element is connected to the pin and generates the tractive force on the pin against a counter-surface of the elongated slots when the attachment arrangement is in the normal position.

15. The attachment arrangement according to claim 10, wherein a counter-spring mechanism is connected to a return mechanism arranged with the lever part and comprises a pin fitted to move in elongated slots made in opposite side walls of the bridge body, wherein support elements rest against the pin due to a tractive force of the strings, and wherein the counter-spring element forms a counterforce element connected to the pin and which generates the tractive force on the pin against a counter-surface of the slots when the attachment arrangement is in a normal position.

16. The attachment arrangement according to claim 15, wherein the counter-spring mechanism is connected to the pin by a draw wire or a draw bar.

17. The attachment arrangement according to claim 1, wherein the moving means comprise a formed element attached to the lever means, wherein a movement of the lever means is transmitted into a movement of at least one moving mechanism and one or more restraining means, wherein the attachment arrangement further comprises a return mechanism having a counterforce element arranged to return the lever means and the attachment arrangement to a normal position when the lever part is released after having been pressed downwards, wherein a counter-surface is arranged in the bridge body and wherein the return mechanism and the lever means are arranged against the counter-surface to stop following the release of the lever part, and wherein the attachment arrangement further comprises a counter-spring mechanism connected to the lever means and arranged to function over the entire movement of the lever means in a string-tensioning direction.

18. The attachment arrangement according to claim 1, wherein the stringed instrument is a guitar.

* * * * *